US008900510B2

(12) United States Patent
Kawabata

(10) Patent No.: US 8,900,510 B2
(45) Date of Patent: Dec. 2, 2014

(54) HEAT-RESISTANT, FERRITIC CAST STEEL HAVING EXCELLENT ROOM-TEMPERATURE TOUGHNESS, AND EXHAUST MEMBER MADE THEREOF

(75) Inventor: Masahide Kawabata, Moka (JP)

(73) Assignee: Hitachi Metals, Ltd., Tokyo (JP)

( * ) Notice: Subject to any disclaimer, the term of this patent is extended or adjusted under 35 U.S.C. 154(b) by 254 days.

(21) Appl. No.: 13/637,927

(22) PCT Filed: Mar. 31, 2011

(86) PCT No.: PCT/JP2011/058331

§ 371 (c)(1),
(2), (4) Date: Sep. 27, 2012

(87) PCT Pub. No.: WO2011/125901

PCT Pub. Date: Oct. 13, 2011

(65) Prior Publication Data

US 2013/0022489 A1 Jan. 24, 2013

(30) Foreign Application Priority Data

Mar. 31, 2010 (JP) ..... 2010-081710
Aug. 31, 2010 (JP) ..... 2010-194543

(51) Int. Cl.

| | |
|---|---|
| ***C22C 38/26*** | (2006.01) |
| ***C22C 38/22*** | (2006.01) |
| ***C22C 38/48*** | (2006.01) |
| ***C22C 38/44*** | (2006.01) |
| ***F01N 13/16*** | (2010.01) |
| ***C22C 38/02*** | (2006.01) |
| ***C22C 38/04*** | (2006.01) |
| ***C21D 6/00*** | (2006.01) |
| ***C22C 38/00*** | (2006.01) |

(52) U.S. Cl.

CPC ..... *C22C 38/26* (2013.01); *F01N 2530/00* (2013.01); *C22C 38/02* (2013.01); *C21D 2211/005* (2013.01); *F01N 13/16* (2013.01); *C22C 38/48* (2013.01); *C22C 38/44* (2013.01); *C22C 38/04* (2013.01); *C21D 6/002* (2013.01); *C22C 38/001* (2013.01)

USPC ..... 420/69; 420/70; 420/42; 148/325; 148/326

(58) Field of Classification Search

None

See application file for complete search history.

(56) References Cited

U.S. PATENT DOCUMENTS

| | | | | | |
|---|---|---|---|---|---|
| 2,225,730 | A | * | 12/1940 | Armstrong | 148/326 |
| 3,029,171 | A | * | 4/1962 | Carter et al. | 148/607 |
| 3,963,532 | A | * | 6/1976 | Demo, Jr. | 420/63 |

(Continued)

FOREIGN PATENT DOCUMENTS

| | | | |
|---|---|---|---|
| JP | 53-48916 | A | 5/1978 |
| JP | 4-218645 | A | 8/1992 |
| JP | 7-197209 | A | 8/1995 |
| JP | 11-61343 | A | 3/1999 |
| JP | 2002-309935 | A | 10/2002 |
| JP | 2007-254885 | A | 10/2007 |

*Primary Examiner* — Deborah Yee

(74) *Attorney, Agent, or Firm* — Sughrue Mion, PLLC

(57) ABSTRACT

A heat-resistant, ferritic cast steel having excellent room-temperature toughness, which has a composition comprising by mass 0.32-0.48% of C, 0.85% or less of Si, 2% or less of Mn, 1.5% or less of Ni, 16-19.8% of Cr, 3.2-5% of Nb, Nb/C being 9-11.5, 0.15% or less of N, 0.002-0.2% of S, and 0.8% or less in total of W and/or Mo, the balance being Fe and inevitable impurities, and a structure in which a eutectic (δ+NbC) phase formed from a δ phase and Nb carbide (NbC) has an area ratio of 60-90%, and an exhaust member made thereof.

2 Claims, 3 Drawing Sheets

(56) References Cited

U.S. PATENT DOCUMENTS 5,152,850 A 10/1992 Takahashi et al.
5,340,414 A * 8/1994 Asai et al. ..... 148/325
5,582,657 A 12/1996 Watanabe et al.
2007/0215252 A1 9/2007 Takabayashi et al.
2009/0120536 A1* 5/2009 Tomita et al. ..... 148/326
2013/0195713 A1* 8/2013 Kawabata et al. ..... 420/42
2013/0206271 A1* 8/2013 Wieser et al. ..... 138/143

* cited by examiner

Ingot A (One-Inch Y-Block) (unit : mm)

Ingot B (Stepped Y-Block) (unit : mm)

HEAT-RESISTANT, FERRITIC CAST STEEL HAVING EXCELLENT ROOM-TEMPERATURE TOUGHNESS, AND EXHAUST MEMBER MADE THEREOF

This application is a National Stage of International Application No. PCT/JP2011/058331 filed on Mar. 31, 2011, which claims priority from Japanese Patent Application No. 2010-081710, filed on Mar. 31, 2010 and Japanese Patent Application No. 2010-194543, filed on Aug. 31, 2010, the contents of all of which are incorporated herein by reference in their entirety.

FIELD OF THE INVENTION

The present invention relates to heat-resistant, ferritic cast steel having excellent room-temperature toughness, which is suitable for exhaust members, particularly exhaust manifolds, etc., for gasoline engines and diesel engines of automobiles, and an exhaust member made thereof.

BACKGROUND OF THE INVENTION

To prevent global warming, the reduction of the amount of a $CO_2$ gas exhausted from automobiles is strongly demanded. To reduce the amount of a $CO_2$ gas exhausted, it is mainly necessary to improve the fuel efficiency of automobiles. Technologies for improving fuel efficiency include fuel direct injection systems, increase in compression ratios, the reduction (downsizing) of engine weights and sizes by supercharging, increase in the boost pressure of turbochargers, etc. With these technologies introduced, fuel combustion tends to occur at higher temperatures and higher pressure in engines, so that the temperatures of exhaust gases discharged from engine combustion chambers to exhaust members such as exhaust manifolds, catalyst cases, etc. are elevated to nearly 1000° C. Exhaust members exposed to such high-temperature exhaust gases are required to have excellent heat resistance characteristics (oxidation resistance, thermal cracking resistance, thermal deformation resistance). To exhaust manifolds, etc. among the exhaust members, oxidation resistance and thermal cracking resistance are particularly important.

Conventionally used for exhaust members such as exhaust manifolds, etc. used under severe conditions at high temperatures are heat-resistant cast iron such as high-Si, spheroidal graphite cast iron and Ni-Resist cast iron (austenitic cast Ni—Cr iron), heat-resistant, ferritic cast steel, heat-resistant, austenitic cast steel, etc. Ferritic, spheroidal graphite cast iron containing 4% Si and 0.5% Mo exhibits relatively good heat resistance up to about 800° C., but is poor in durability at temperatures higher than 800° C. Heat-resistant cast iron such as Ni-Resist cast iron and heat-resistant, austenitic cast steel, which contain large amounts of rare metals such as Ni, Cr, Co, etc., have satisfactory oxidation resistance and thermal cracking resistance at temperatures of 800° C. or higher. However, the Ni-Resist cast iron is expensive because of a large Ni content, and has poor thermal cracking resistance because it has a large coefficient of linear expansion due to an austenitic matrix structure, and because its microstructure contains graphite acting as the starting points of fracture. The heat-resistant, austenitic cast steel has insufficient thermal cracking resistance at about 900° C. because of a large coefficient of linear expansion, though not containing graphite acting as the starting points of fracture. In addition, it is expensive because it contains large amounts of rare metals, and unstable in material supply affected by world economic conditions.

From the aspect of economic feasibility, stable material supply and efficient use of resources, heat-resistant cast steels for exhaust members desirably have necessary heat resistance with the amounts of rare metals minimized. Thus provided are inexpensive, high-performance exhaust members, which enable the application of fuel-efficiency-improving technologies to inexpensive popular cars, contributing to reducing the amount of a $CO_2$ gas exhausted. To reduce the amounts of rare metals contained as much as possible, the matrix structures of alloys are advantageously ferrite rather than austenite. In addition, because the heat-resistant, ferritic cast steel has a smaller coefficient of linear expansion than that of the heat-resistant, austenitic cast steel, the former has better thermal cracking resistance because of smaller thermal stress generated at the start and acceleration of engines.

The heat-resistant, ferritic cast steel has poor toughness at room temperature, because it contains a large amount of Cr for oxidation resistance. Exhaust members are subject to mechanical vibration and shock in their production process, their assembling process to engines, etc. Accordingly, heat-resistant, ferritic cast steels used for exhaust members should have sufficient room-temperature toughness to avoid cracking and fracture by mechanical vibration and shock.

JP 2007-254885 A discloses a thin casting part made of Fe-based, ferritic, cast stainless steel comprising 0.10-0.50% by mass of C, 1.00-4.00% by mass of Si, 0.10-3.00% by mass of Mn, 8.0-30.0% by mass of Cr, and 0.1-5.0% by mass of Nb and/or V, which has thin portions having thickness of 1-5 mm, a ferrite phase in the structure of thin portions having an average crystal grain size of 50-400 μm to exhibit improved high-temperature strength. Because thin portions of 5 mm or less in this thin casting part are rapidly cooled after casting, the ferrite phase has a small average crystal grain size, resulting in high high-temperature yield strength, high tensile strength and large fracture elongation.

However, exhaust members have cylinder-head-mounting flanges, heat-insulation-plate-mounting bosses, bolt-fastening portions, etc., which are as thick as 5 mm or more, and so low in cooling speeds. The cooling speed is also low in portions near risers for preventing shrinkage cavities, and portions formed by adjacent cavities in a sand mold which tend to be overheated, even though they are as thin as 5 mm or less. Such low-cooling-speed portions have large average crystal grain sizes, resulting in low room-temperature toughness. However, JP 2007-254885 A fails to disclose means for suppressing toughness decrease. Also, the heat-resistant, ferritic cast steel of JP 2007-254885 A has improved melt flowability, which is obtained by lowering its melting point by containing a large amount of Si, and high-temperature strength, oxidation resistance, carburizing resistance and machinability, but it has low room-temperature toughness because it contains Si in as large an amount as 1.00-4.00% by mass (about 2% or more in Examples), Si being dissolved in a ferritic matrix structure. The average crystal grain size should be made smaller even in other portions than thin portions to obtain high room-temperature toughness, and the solid solution of alloying elements in the matrix structure should be minimized to avoid embrittlement. However, JP 2007-254885 A does not achieve these objectives.

JP 7-197209 A discloses heat-resistant, ferritic cast steel having a composition comprising by weight 0.15-1.20% of C, 0.05-0.45% of C—Nb/8, 2% or less of Si, 2% or less of Mn, 16.0-25.0% of Cr, 1.0-5.0% of W and/or Mo, 0.40-6.0% of Nb, 0.1-2.0% of Ni, and 0.01-0.15% of N, the balance being Fe and inevitable impurities, and having an α' phase (α+carbide) transformed from a γ phase (austenite phase), in addition to a usual a phase (a ferrite phase), the area ratio of the α' phase [α'/(α+α')] being 20-70% to improve castability.

Because this heat-resistant, ferritic cast steel contains C (austenitizing element) in an amount more than necessary for forming NbC, C dissolved in the matrix structure forms a γ phase when solidified. The γ phase is transformed to an α' phase in a cooling process, thereby improving ductility and oxidation resistance. Accordingly, this heat-resistant, ferritic cast steel is suitable for exhaust members used at 900° C. or higher.

However, the transformation of the γ phase to the α' phase does not proceed sufficiently in an as-cast state, and the γ phase is transformed to a martensite phase. Because the martensite phase has high hardness, it extremely deteriorates room-temperature toughness and machinability. To secure high toughness and machinability, a heat treatment for erasing the martensite phase and precipitating the α' phase is needed. Because a heat treatment generally increases production costs, it damages the economic advantage of the heat-resistant, ferritic cast steel containing small amounts of rare metals.

JP 11-61343 A discloses heat-resistant, ferritic cast steel having a composition comprising by weight 0.05-1.00% of C, 2% or less of Si, 2% or less of Mn, 16.0-25.0% of Cr, 4.0-20.0% of Nb, 1.0-5.0% of W and/or Mo, 0.1-2.0% of Ni, and 0.01-0.15% of N, the balance being Fe and inevitable impurities, and having a Laves phase ($Fe_2$ M) in addition to a usual a phase, thereby having high-temperature strength, particularly excellent creep rupture strength. Though this heat-resistant, ferritic cast steel has improved high-temperature strength, particularly creep rupture strength because of a Laves phase by a combination of Nb, W, Mo, Ni and N, its room-temperature toughness is not necessarily sufficient because it contains large amounts of alloying elements.

Object of the Invention

Accordingly, an object of the present invention is to provide heat-resistant, ferritic cast steel having excellent room-temperature toughness as well as high oxidation resistance and thermal cracking resistance at about 900° C., and an exhaust member such as an exhaust manifold, etc. made of this heat-resistant, ferritic cast steel.

SUMMARY OF THE INVENTION

In view of the above object, heat-resistant, ferritic cast steel containing about 15-20% by mass of Cr has been used as a basic composition to investigate the improvement of its room-temperature toughness in an as-cast state without deteriorating its heat resistance. As a result, the following has been found.

(1) When thin castings having complicated shapes such as exhaust members are produced, casting materials are required to have good flowability. To improve the flowability, it is generally effective to add more C to lower their solidification start temperatures, but the mere addition of C deteriorates toughness by increase in the amount of Cr carbide precipitated, and by the crystallization of a γ phase transformed to martensite. It has been found that to improve the flowability while suppressing decrease in toughness, both C and Nb should be increased. In general, when alloying elements are dissolved in a matrix structure, or when crystals or precipitates are formed therein, to improve strength, etc., the toughness of a δ phase having a body-centered cubic (BCC) structure decreases. It is thus expected that the addition of large amounts of C and Nb to heat-resistant, ferritic cast steel lowers its toughness, but the fact is contrary; the toughness has been improved drastically. The reason for improving the toughness is presumably that because increase in C and Nb leads to increase in a eutectic (δ+NbC) phase formed from a δ phase and Nb carbide (NbC) and decrease in a primary δ phase, the eutectic (δ+NbC) phase starts to be crystallized before the primary δ phase grows, both suppressing growth each other, resulting in fine crystal grains of both primary δ phase and eutectic (δ+NbC) phase. To obtain fine crystal grains of a primary δ phase and a eutectic (δ+NbC) phase, their crystallized amounts should be optimized.

(2) To prevent the crystallization of the γ phase harmful to the toughness, and to suppress the solid solution of Nb in the δ phase, in addition to making finer crystal grains of the primary δ phase and the eutectic (δ+NbC) phase, a balance of the C content and the Nb content is important. It has been found that with a ratio (Nb/C) of the Nb content to the C content limited to a desired range, Nb and C are not substantially dissolved in a ferritic matrix structure, but precipitated in the form of Nb carbide (NbC). As a result, the γ phase is not crystallized with minimum solid solution of Nb in the δ phase, thereby suppressing the deterioration of toughness.

Accordingly, with the amounts of C, Si, Nb, etc. controlled to desired ranges, and with the primary δ phase (δ ferrite phase) and the eutectic (δ+NbC) phase formed from the δ phase and the Nb carbide (NbC) coexisting at an optimum ratio, the heat-resistant, ferritic cast steel is provided with excellent room-temperature toughness, as well as high oxidation resistance and thermal cracking resistance at about 900° C.

Thus, the heat-resistant, ferritic cast steel of the present invention having excellent room-temperature toughness has a composition comprising by mass 0.32-0.48% of C,
0.85% or less of Si,
2% or less of Mn,
1.5% or less of Ni,
16-19.8% of Cr,
3.2-5% of Nb,
Nb/C being 9-11.5,
0.15% or less of N,
0.002-0.2% of S, and
0.8% or less in total of W and/or Mo,
the balance being Fe and inevitable impurities, and a structure in which a eutectic (δ+NbC) phase formed from a δ phase and Nb carbide (NbC) has an area ratio of 60-90%.

The exhaust member of the present invention is made of the above heat-resistant, ferritic cast steel. Such exhaust members include exhaust manifolds, turbine housings, integrally cast turbine housings/exhaust manifolds, catalyst cases, integrally cast catalyst cases/exhaust manifolds, and exhaust outlets, preferably exhaust manifolds, catalyst cases, integrally cast catalyst cases/exhaust manifolds, and exhaust outlets.

DESCRIPTION OF THE PREFERRED EMBODIMENTS

[1] Heat-Resistant, Ferritic Cast Steel

Figure 1:
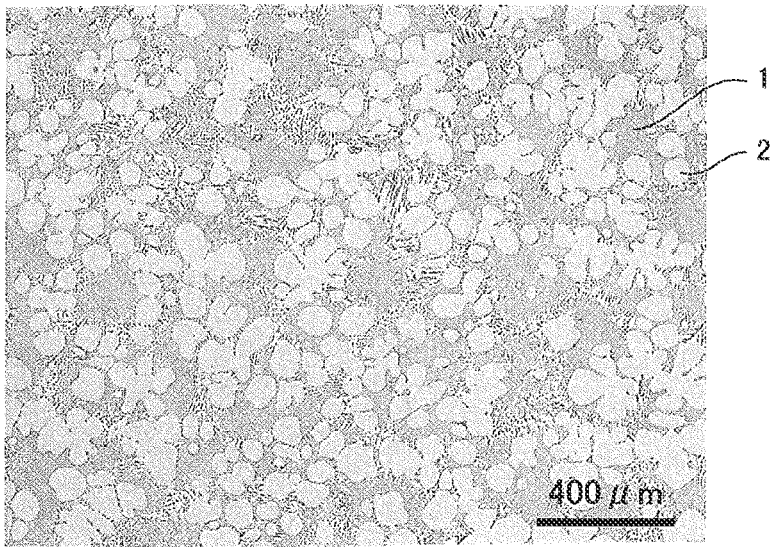
FIG. 1 is an optical photomicrograph (magnification: 100 times) showing the microstructure of the heat-resistant, ferritic cast steel of Example 8.

The composition and structure of the heat-resistant, ferritic cast steel of the present invention will be explained in detail below. The term "%" indicating the amount of each element means "% by mass," unless otherwise mentioned.

(A) Composition (1) C (carbon): 0.32-0.48%

C has a function of lowering a solidification start temperature to improve the flowability (castability) of a melt. Also, C is combined with Nb, forming the eutectic (δ+NbC) phase from the δ phase and the Nb carbide (NbC), thereby increasing the high-temperature strength. To exhibit such a function effectively, the amount of C should be 0.32% or more. However, more than 0.48% of C form too large an amount of the eutectic (δ+NbC) phase, making the heat-resistant, ferritic cast steel brittle, and reducing its room-temperature toughness. Accordingly, the amount of C is 0.32-0.48%. The amount of C is preferably 0.32-0.45%, more preferably 0.32-0.44%, most preferably 0.32-0.42%.

(2) Si (Silicon): 0.85% or Less

Si functions as a deoxidizer for a melt, and improves the oxidation resistance. However, when Si exceeds 0.85%, it is dissolved in the ferritic matrix structure, making the matrix structure extremely brittle. Accordingly, the amount of Si is 0.85% or less (not including 0%). The amount of Si is preferably 0.2-0.85%, more preferably 0.3-0.85%, most preferably 0.35-0.85%.

(3) Mn (Manganese): 2% or Less

Mn is effective as a deoxidizer for a melt like Si, but more than 2% of Mn deteriorates the oxidation resistance of the heat-resistant, ferritic cast steel. Accordingly, the amount of Mn is 2% or less (not including 0%). The amount of Mn is preferably 0.1-2%, more preferably 0.1-1.5%, most preferably 0.2-1.2%.

(4) Ni (Nickel): 1.5% or Less

Ni is an element for stabilizing the austenite, forming a γ phase. Cooled to room temperature, the austenite is transformed to martensite, which deteriorates the room-temperature toughness. Accordingly, the amount of Ni is preferably as small as possible, but Ni is inevitably contained in the heat-resistant, ferritic cast steel because it is usually contained in starting material scraps. Because the limit of Ni avoiding adverse effects on the room-temperature toughness is 1.5% or less, the amount of Ni is 0-1.5%. The amount of Ni is preferably 0-1.25%, more preferably 0-1.0%, most preferably 0-0.9%.

(5) Cr (Chromium): 16-19.8%

Cr is an element improving the oxidation resistance and stabilizing the ferrite structure. To secure oxidation resistance at about 900° C., Cr should be at least 16%. On the other hand, when Cr is more than 19.8% in the ferrite matrix, σ embrittlement is likely to occur, resulting in poor toughness and machinability. Accordingly, the amount of Cr is 16-19.8%. The amount of Cr is preferably 17-19.8%, more preferably 17-19.5%, most preferably 17.5-19.0%.

(6) Nb (Niobium): 3.2-5%

Nb is combined with C to form the eutectic (δ+NbC) phase, improving the high-temperature strength and lowering the solidification start temperature. A lower solidification start temperature provides flowability important to the production of thin castings having complicated shapes such as exhaust members. Also, Nb fixes C as carbide (NbC) during solidification, so that C, a strong austenite-stabilizing element, is dissolved in the ferritic matrix structure, preventing the crystallization of a γ phase, thereby preventing decrease in toughness. Nb also makes finer crystal grains of the primary δ phase and the eutectic (δ+NbC) phase, remarkably improving the room-temperature toughness. To exhibit the above effect of Nb, the amount of Nb should be 3.2% or more. However, when Nb exceeds 5%, an excessive eutectic (δ+NbC) phase is crystallized, making the heat-resistant, ferritic cast steel brittle. Accordingly, the amount of Nb is 3.2-5%. In the heat-resistant, ferritic cast steel of the present invention, the effect of improving high-temperature strength, flowability and toughness is substantially achieved by about 4% of Nb, and Nb is an expensive rare metal. Accordingly, the amount of Nb is preferably 3.2-4.0%, more preferably 3.2-3.9%, most preferably 3.3-3.9%.

(7) Nb/C: 9-11.5

The limitation of an amount ratio (Nb/C) of Nb to C is most important to obtain excellent room-temperature toughness while securing oxidation resistance and thermal cracking resistance at about 900° C. Nb forms carbide with C, but too large an amount of C (a small Nb/C ratio) leaves excess C not forming Nb carbide to be dissolved in the matrix structure, making the δ phase unstable, thereby permitting the γ phase to be crystallized. The crystallized γ phase is transformed to martensite lowering the room-temperature toughness until reaching room temperature. Also, because a small Nb/C ratio accelerates the growth of the primary δ phase, crystal grains of the primary δ phase are not fully fine, resulting in poor toughness. To provide fine crystal grains of the primary δ phase and the eutectic (δ+NbC) phase while suppressing the crystallization of the γ phase, the Nb/C ratio should be 9 or more.

On the other hand, excess Nb (a large Nb/C ratio) permits Nb to be dissolved in the δ phase, providing lattice strain to the δ phase, thereby reducing the room-temperature toughness of the δ phase. A large Nb/C ratio accelerates the growth of the eutectic (δ+NbC) phase, resulting in insufficiently fine crystal grains of the eutectic (δ+NbC) phase, failing to improve the toughness. To provide fine crystal grains of the primary δ phase and the eutectic (δ+NbC) phase while suppressing the solid solution of Nb in the δ phase, the Nb/C ratio should be 11.5 or less. Thus, the Nb/C ratio is 9-11.5. The Nb/C ratio is preferably 9-11.3, more preferably 9.3-11, most preferably 9.5-10.5.

(8) N (Nitrogen): 0.15% or Less

N is a strong austenite-stabilizing element, forming the γ phase. The γ phase is transformed to martensite while being cooled to room temperature, deteriorating the room-temperature toughness. Accordingly, the amount of N is preferably as small as possible, but N is inevitably contained in starting material scraps. Because the limit of N avoiding adverse effects on the room-temperature toughness is 0.15% or less, the amount of N is 0-0.15%. The amount of N is preferably 0-0.13%, more preferably 0-0.11%, most preferably 0-0.10%.

(9) S (Sulfur): 0.002-0.2%

S forms spherical or granular sulfides in the cast steel, which improve machinability because of their lubricating function. To obtain this effect, S should be 0.002% or more. However, S exceeding 0.2% provides the heat-resistant, ferritic cast steel with low room-temperature toughness. Accordingly, the amount of S is 0.002-0.2%. The amount of S is preferably 0.005-0.2%, more preferably 0.008-0.2%, most preferably 0.01-0.2%.

(10) W (Tungsten) and/or Mo (Molybdenum): 0.8% or Less in Total

W and Mo are dissolved in the δ phase in the matrix structure, providing lattice strain to the ferrite matrix, deteriorating the room-temperature toughness. Accordingly, their amounts are preferably as small as possible. However, W and Mo are usually contained in starting material scraps. When both W and Mo are contained, their total amount (W+Mo) exceeding 0.8% forms coarse carbides, resulting in low room-temperature toughness. Accordingly, the total amount of W and/or Mo is 0-0.8%. The total amount of W and/or Mo is preferably 0-0.6%, more preferably 0-0.5%, most preferably 0-0.3%.

(B) Area Ratio of Eutectic (δ+NbC) Phase: 60-90%

The limitation of the amount of the eutectic (δ+NbC) phase formed from the δ phase and the Nb carbides (NbC), which is crystallized in the heat-resistant, ferritic cast steel of the present invention, is important to secure excellent room-temperature toughness. In the solidification of the heat-resistant, ferritic cast steel of the present invention, the δ phase is first solidified as a primary phase, and a relatively large amount of the eutectic (δ+NbC) phase is solidified after a relatively short period of time. The solidified eutectic (δ+NbC) phase suppresses the growth of the primary δ phase, and the solidified primary δ phase suppresses the growth of the eutectic (δ+NbC) phase. It is thus presumed that the primary δ phase and the eutectic (δ+NbC) phase mutually suppress their growth, so that both primary δ phase and eutectic (δ+NbC) phase are in the form of fine crystal grains, resulting in remarkably improved toughness. To obtain this effect, the area ratio of the eutectic (δ+NbC) phase should be 60-90% based on the total area (100%) of the structure. When the area ratio of the eutectic (δ+NbC) phase is less than 60%, the primary δ phase has coarse crystal grains, failing to drastically improve the room-temperature toughness. When the area ratio of the eutectic (δ+NbC) phase exceeds 90%, the eutectic (δ+NbC) phase is excessive, resulting in coarse crystal grains, so that the heat-resistant, ferritic cast steel is brittle and has low toughness. To limit the area ratio of the eutectic (δ+NbC) phase to 60-90%, it is necessary to limit the amounts of C and Nb and the Nb/C ratio in the above ranges. The area ratio of the eutectic (δ+NbC) phase is preferably 60-87%, more preferably 60-85%, most preferably 60-80%.

[2] Exhaust Members

Preferred examples of the exhaust members of the present invention made of the above heat-resistant, ferritic cast steel include exhaust manifolds, turbine housings, integrally cast turbine housings/exhaust manifolds, catalyst cases, integrally cast catalyst cases/exhaust manifolds, and exhaust outlets, though not restrictive. They also include cast members welded to plate or pipe metal members.

The exhaust members of the present invention keep high oxidation resistance and thermal cracking resistance even when they are exposed to an exhaust gas at as high temperatures as 1000° C. or higher such that their surface temperatures reach about 900° C., thereby exhibiting excellent heat resistance and durability. Accordingly, they are particularly suitable for exhaust manifolds, catalyst cases, integrally cast catalyst cases/exhaust manifolds, and exhaust outlets required to have high oxidation resistance and thermal cracking resistance. Because of excellent room-temperature toughness, the exhaust members are free from cracking and fracture even with mechanical vibration and shock, etc. in their production process, an assembling process to engines, etc. In addition, they are inexpensive because of the reduced amounts of rare metals. Namely, because the exhaust members of the present invention are inexpensive with high heat resistance and durability, they are usable in popular cars with expanding fuel-efficiency-improving technologies, so that it is expected that they largely contribute to reducing the amount of a $CO_2$ gas exhausted.

The present invention will be explained in further detail by Examples below without intention of restricting the present invention thereto. Unless otherwise mentioned, the amount of each element is expressed by % by mass.

Examples 1-20 and Comparative Examples 1-21

The chemical compositions of the cast steels of Examples 1-20 and Comparative Examples 1-21 are shown in Table 1. Examples 1-20 show heat-resistant, ferritic cast steels within the composition ranges of the present invention, and Comparative Examples 1-18 show cast steels outside the composition ranges of the present invention. Too small amounts of C and Nb were contained in Comparative Examples 1 and 2, too large amounts of C and Nb were contained in the cast steels of Comparative Examples 3 and 4, too small an amount of Cr was contained in the cast steel of Comparative Example 5, too large an amount of Cr was contained in the cast steels of Comparative Examples 6 and 7, too small an amount of C was contained in the cast steel of Comparative Example 8, too large an amount of C was contained in the cast steel of Comparative Example 9, too small an amount of Nb was contained in the cast steel of Comparative Example 10, too large an amount of Nb was contained in the cast steel of Comparative Example 11, the Nb/C ratio was too large in the cast steel of Comparative Example 12, the Nb/C ratio was too small in the cast steels of Comparative Examples 13 and 14, too large an amount of Si was contained in the cast steels of Comparative Examples 15 and 16, too large an amount of W was contained in the cast steel of Comparative Example 17, and too large an amount of Mo was contained in the cast steel of Comparative Example 18. The cast steel of Comparative Example 19 was one example of the ferritic cast stainless steels described in JP 2007-254885 A, the cast steel of Comparative Example 20 was one example of the heat-resistant, ferritic cast steels described in JP 7-197209 A, and the cast steel of Comparative Example 21 was one example of the heat-resistant, ferritic cast steels described in JP 11-61343 A.

TABLE 1

| | Chemical Composition(1) (% by mass) | | | | | | | | | | |
|---|---|---|---|---|---|---|---|---|---|---|---|
| No. | C | Si | Mn | S | Ni | Cr | W(2) | Mo(2) | Nb | N | Nb/C |
| Example 1 | 0.33 | 0.68 | 0.80 | 0.011 | 0.66 | 16.1 | — | — | 3.4 | 0.077 | 10.3 |
| Example 2 | 0.37 | 0.75 | 0.82 | 0.010 | 0.72 | 16.2 | 0.1 | 0.1 | 3.7 | 0.075 | 10.0 |
| Example 3 | 0.47 | 0.70 | 0.85 | 0.007 | 0.70 | 16.1 | — | — | 4.8 | 0.080 | 10.2 |
| Example 4 | 0.34 | 0.66 | 0.79 | 0.012 | 0.72 | 17.9 | 0.1 | — | 3.4 | 0.080 | 10.0 |
| Example 5 | 0.39 | 0.65 | 0.77 | 0.006 | 0.59 | 18.0 | 0.1 | 0.1 | 3.8 | 0.075 | 9.7 |
| Example 6 | 0.42 | 0.72 | 0.82 | 0.009 | 0.70 | 18.2 | 0.1 | — | 4.2 | 0.079 | 10.0 |

TABLE 1-continued

| No. | Chemical Composition[1] (% by mass) | | | | | | | | | | |
|---|---|---|---|---|---|---|---|---|---|---|---|
| | C | Si | Mn | S | Ni | Cr | W[2] | Mo[2] | Nb | N | Nb/C |
| Example 7 | 0.47 | 0.70 | 0.80 | 0.010 | 0.71 | 17.9 | — | — | 4.8 | 0.082 | 10.2 |
| Example 8 | 0.33 | 0.77 | 0.80 | 0.009 | 0.75 | 19.5 | 0.1 | — | 3.4 | 0.080 | 10.3 |
| Example 9 | 0.38 | 0.75 | 0.74 | 0.008 | 0.77 | 19.6 | — | 0.1 | 3.7 | 0.079 | 9.7 |
| Example 10 | 0.47 | 0.70 | 0.77 | 0.007 | 0.72 | 19.6 | 0.1 | 0.1 | 4.7 | 0.085 | 10.0 |
| Example 11 | 0.37 | 0.65 | 0.82 | 0.005 | 0.69 | 17.9 | 0.3 | 0.3 | 3.8 | 0.085 | 10.3 |
| Example 12 | 0.37 | 0.65 | 0.80 | 0.005 | 0.68 | 18.2 | 0.7 | 0.1 | 3.7 | 0.081 | 10.0 |
| Example 13 | 0.37 | 0.66 | 0.82 | 0.010 | 0.80 | 18.0 | 0.1 | 0.7 | 3.8 | 0.075 | 10.3 |
| Example 14 | 0.40 | 0.65 | 0.78 | 0.011 | — | 18.1 | — | — | 3.8 | 0.073 | 9.5 |
| Example 15 | 0.41 | 0.68 | 0.75 | 0.010 | 0.53 | 18.2 | — | — | 3.7 | — | 9.0 |
| Example 16 | 0.42 | 0.67 | 0.76 | 0.012 | — | 18.1 | — | — | 3.9 | — | 9.3 |
| Example 17 | 0.41 | 0.35 | 1.02 | 0.011 | 0.62 | 16.2 | — | — | 4.0 | 0.098 | 9.8 |
| Example 18 | 0.40 | 0.85 | 0.28 | 0.008 | 1.25 | 19.8 | — | — | 3.6 | 0.145 | 9.0 |
| Example 19 | 0.35 | 0.73 | 0.81 | 0.013 | 0.67 | 18.5 | — | — | 3.2 | 0.102 | 9.1 |
| Example 20 | 0.43 | 0.71 | 0.83 | 0.010 | 0.65 | 18.4 | — | — | 4.9 | 0.098 | 11.4 |
| Comp. Ex. 1 | 0.29 | 0.69 | 0.82 | 0.010 | 0.70 | 17.8 | 0.1 | — | 2.8 | 0.077 | 9.7 |
| Comp. Ex. 2 | 0.31 | 0.70 | 0.75 | 0.009 | 0.72 | 18.0 | 0.1 | — | 3.1 | 0.075 | 10.0 |
| Comp. Ex. 3 | 0.52 | 0.74 | 0.77 | 0.009 | 0.55 | 18.1 | 0.1 | 0.1 | 5.2 | 0.079 | 10.0 |
| Comp. Ex. 4 | 0.57 | 0.69 | 0.82 | 0.010 | 0.68 | 17.9 | — | — | 5.5 | 0.081 | 9.6 |
| Comp. Ex. 5 | 0.40 | 0.68 | 0.80 | 0.011 | 0.70 | 15.6 | 0.1 | — | 4.2 | 0.080 | 10.5 |
| Comp. Ex. 6 | 0.38 | 0.71 | 0.78 | 0.008 | 0.73 | 20.0 | — | — | 3.8 | 0.078 | 10.0 |
| Comp. Ex. 7 | 0.33 | 0.74 | 0.82 | 0.012 | 0.75 | 25.3 | — | — | 3.2 | 0.065 | 9.7 |
| Comp. Ex. 8 | 0.30 | 0.68 | 0.79 | 0.009 | 0.71 | 18.2 | 0.1 | — | 3.4 | 0.077 | 11.3 |
| Comp. Ex. 9 | 0.51 | 0.70 | 0.77 | 0.010 | 0.68 | 18.0 | 0.1 | — | 4.7 | 0.078 | 9.2 |
| Comp. Ex. 10 | 0.32 | 0.69 | 0.81 | 0.008 | 0.72 | 17.8 | 0.1 | — | 2.9 | 0.082 | 9.1 |
| Comp. Ex. 11 | 0.48 | 0.66 | 0.80 | 0.007 | 0.69 | 17.7 | 0.1 | — | 5.5 | 0.080 | 11.5 |
| Comp. Ex. 12 | 0.32 | 0.70 | 0.85 | 0.007 | 0.76 | 17.8 | — | — | 4.8 | 0.077 | 15.0 |
| Comp. Ex. 13 | 0.45 | 0.71 | 0.80 | 0.009 | 0.72 | 17.9 | 0.1 | 0.1 | 3.8 | 0.075 | 8.4 |
| Comp. Ex. 14 | 0.45 | 0.72 | 0.77 | 0.009 | 0.69 | 18.1 | 0.1 | 0.1 | 3.3 | 0.072 | 7.3 |
| Comp. Ex. 15 | 0.42 | 0.90 | 0.75 | 0.010 | 0.71 | 18.0 | — | — | 4.2 | 0.071 | 10.0 |
| Comp. Ex. 16 | 0.40 | 1.20 | 0.76 | 0.011 | 0.70 | 17.9 | 0.1 | — | 4.2 | 0.079 | 10.5 |
| Comp. Ex. 17 | 0.39 | 0.73 | 0.80 | 0.007 | 0.63 | 18.1 | 1.0 | 0.1 | 3.8 | 0.082 | 9.7 |
| Comp. Ex. 18 | 0.38 | 0.69 | 0.82 | 0.008 | 0.77 | 18.2 | 0.1 | 1.1 | 3.7 | 0.083 | 9.7 |
| Comp. Ex. 19 | 0.25 | 2.80 | 0.52 | 0.010 | 0.12 | 20.1 | — | 0.1 | 3.8 | 0.005 | 15.2 |
| Comp. Ex. 20 | 0.45 | 0.95 | 0.54 | 0.009 | 0.95 | 19.9 | 2.9 | — | 2.0 | 0.060 | 4.4 |
| Comp. Ex. 21 | 0.41 | 0.51 | 0.49 | 0.010 | 0.83 | 18.5 | 1.9 | — | 4.2 | 0.055 | 10.2 |

Note:
[1]The balance are Fe and inevitable impurities.
[2]The symbol "—" means that W and Mo were less than 0.1% by mass.

Figure 2:
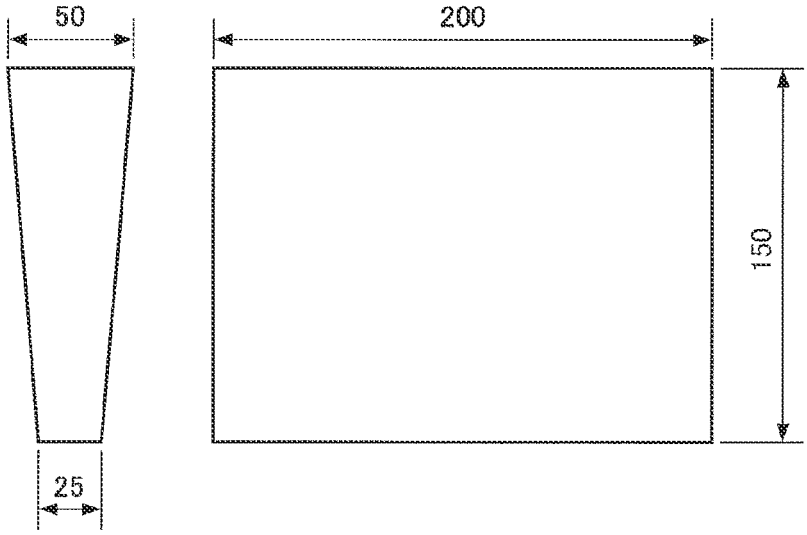
FIG. 2 is a schematic view showing a one-inch Y-block ingot A from which test pieces are cut out.
Figure 3:
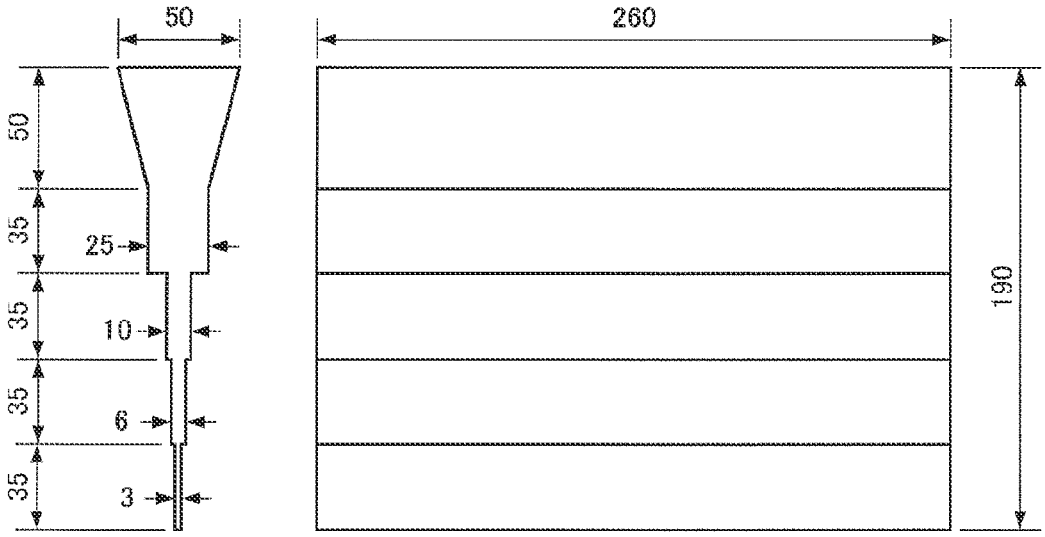
FIG. 3 is a schematic view showing a stepped Y-block ingot B from which test pieces are cut out.

Each cast steel was melted in a 100-kg, high-frequency furnace with a basic lining in the air, taken out of the furnace at 1600-1650° C., and immediately poured at 1530-1560° C. into two types of molds to cast a one-inch Y-block ingot A shown in FIG. 2, and a stepped Y-block ingot B shown in FIG. 3. The sizes of the ingots are shown in FIGS. 2 and 3. Test pieces used in the following evaluation tests were cut out of a portion of the ingot A about 30 mm from the bottom and a 10-mm-thick portion of the ingot B.

(1) Impact Test

To evaluate their room-temperature toughness, their shock resistance was measured by a Charpy impact test. Though tensile elongation (ductility) is sometimes measured to evaluate the toughness, the resistance to mechanical vibration and shock (resistance to cracking and fracture) is more practically evaluated by susceptibility to fracture with a high crack propagation speed than elongation. Accordingly, the toughness was evaluated by the Charpy impact test, which has a higher crack propagation speed than that of the tensile test.

A 7.5-mm-wide test piece was cut out of a 10-mm-thick portion of the ingot B, as a notchless Charpy impact test piece according to JIS Z 2242. Using a Charpy impact test machine having a capacity of 50 J, the impact test was conducted on three test pieces under the same conditions at 23° C. according to JIS Z 2242, and the measured impact values were averaged. The impact test results are shown in Table 2.

Figure 4:
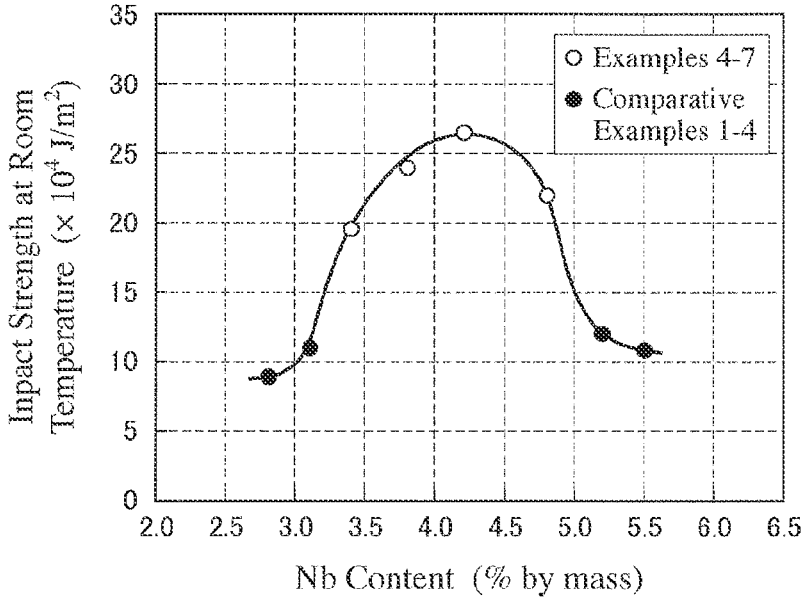
FIG. 4 is a graph showing the relation between the Nb content and impact strength at room temperature.
Figure 5:
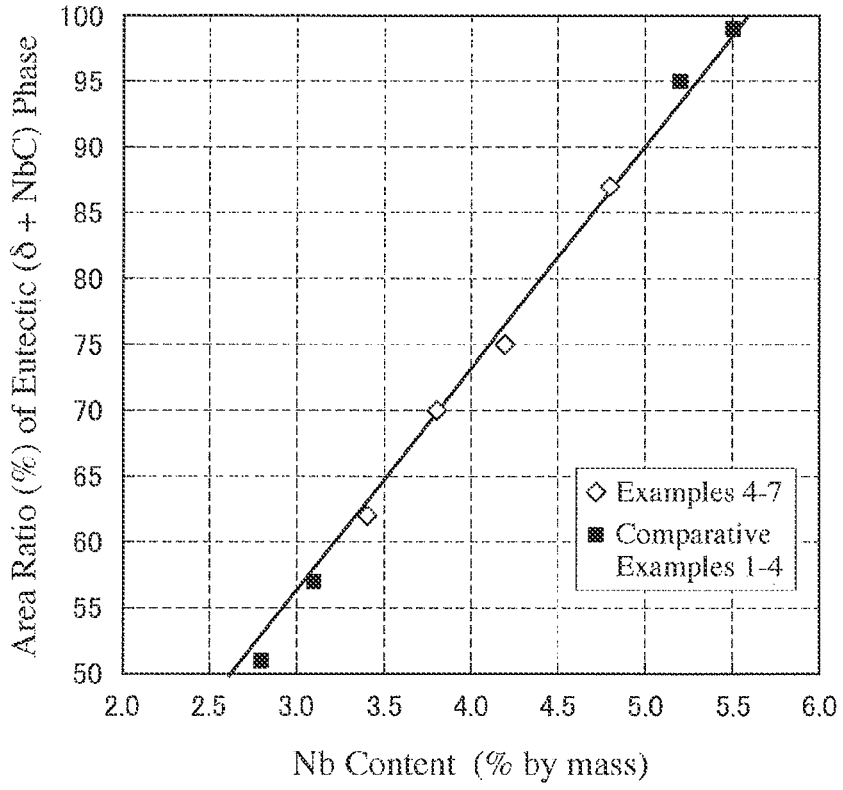
FIG. 5 is a graph showing the relation between the Nb content and the area ratio of a eutectic (δ+NbC) phase.

In order that exhaust members have excellent toughness to avoid cracking and fracture in their production process, etc., they preferably have impact strength of $15\times10^4$ J/m$^2$ or more at room temperature. The impact strength was $15\times10^4$ J/m$^2$ or more at room temperature in all of Examples 1-20. FIG. 4 shows the relation between the amount of Nb and impact strength ($\times10^4$ J/m$^2$) at room temperature in the test pieces of Examples 4-7 and Comparative Examples 1-4 having Nb/C ratios of about 10. As is clear from FIG. 4, the impact strength was $15\times10^4$ J/m$^2$ or more at room temperature with the amount of Nb in a range of 3.2-5%. As is clear from FIG. 5 showing the relation between the amount of Nb and the area ratio of the eutectic (δ+NbC) phase, the area ratio of the eutectic (δ+NbC) phase was 60-90% with the amount of Nb in a range of 3.2-5%. It is considered that the heat-resistant, ferritic cast steel of the present invention meeting the requirements of the amounts of C and Nb and the Nb/C ratio has high impact strength at room temperature because of fine crystal grains of the primary δ phase and the eutectic (δ+NbC) phase due to the coexistence of the primary δ phase and the eutectic (δ+NbC) phase in an optimum ratio.

Any cast steel of Comparative Examples 1-4 and 6-21 outside the composition ranges of the present invention had low impact strength at room temperature. The reasons for low impact strength at room temperature are as follows; (1) in Comparative Examples 1 and 2, the eutectic (δ+NbC) phase was insufficient because of too small amounts of C and Nb, (2) in Comparative Examples 3 and 4, the eutectic (δ+NbC) phase was excessive to provide embrittlement because of too large amounts of C and Nb, (3) in Comparative Example 6 and 7, Cr was excessive, (4) in Comparative Example 8 and 10, the eutectic (δ+NbC) phase was insufficient because of too small an amount of C or Nb, (5) in Comparative Example 9, C, a strong austenitizing element, was so excessive that austenite formed when a matrix structure containing an excessive part of C was solidified was transformed to low-toughness martensite during cooling to room temperature, (6) in Comparative Example 11, Nb having a large atomic radius was so excessive that lattice strain was introduced when an excessive part of Nb was dissolved in the ferrite matrix, (7) in Comparative Example 12, Nb was excessive because of too high a Nb/C ratio as in Comparative Example 11, (8) in Comparative Examples 13 and 14, C, a strong austenitizing element, was excessive because of too low a Nb/C ratio as in Comparative Example 9, (9) in Comparative Examples 15 and 16, too much Si made the ferritic matrix structure brittle, and (10) in Comparative Examples 17 and 18, too large an amount of W or Mo having a large atomic radius was contained, so that lattice strain was introduced when W or Mo was dissolved in the ferritic matrix structure.

Because Comparative Example 19 corresponding to the ferritic cast stainless steel of JP 2007-254885 A contains Si in as large an amount as 2.8%, Si makes the ferritic matrix structure brittle, resulting in low shock resistance. Because Comparative Example 20 corresponding to the heat-resistant, ferritic cast steel of JP 7-197209 A has too small a Nb/C ratio, it contains an insufficient amount of a eutectic (δ+NbC) phase, and excess C, a strong austenitizing element, as in Comparative Example 9, resulting in low shock resistance. Because Comparative Example 21 corresponding to the heat-resistant, ferritic cast steel of JP 11-61343 A contains too much W having a large atomic radius, lattice strain is introduced when W is dissolved in the ferrite matrix, resulting in low shock resistance. Comparative Example 5 containing a small amount of Cr has insufficient oxidation resistance because of large weight loss by oxidation, despite sufficient impact values.

(2) Microstructure

A sample cut out of an end portion of each test piece after the impact test was mirror-polished, etched, and taken photographs in five arbitrary fields by an optical microscope (magnification: 100 times). The photographs were image-analyzed to measure the area ratio of the eutectic (δ+NbC) phase, and the measured area ratios were averaged. The area ratio of the eutectic (δ+NbC) phase is shown in Table 2. FIG. 1 shows the microstructure (100 times) of the heat-resistant, ferritic cast steel of Example 8. The microstructure comprised a primary δ phase 2 and a lamellar eutectic (δ+NbC) phase 1. In Example 8, the area ratio of the eutectic (δ+NbC) phase was 62%.

(3) Weight Loss by Oxidation

Because exhaust members are exposed to an oxidizing, high-temperature exhaust gas containing nitrogen oxides, etc., oxidation resistance is necessary for them. Because the temperature of an exhaust gas discharged from engines is as high as about 1000° C., heating exhaust members such as exhaust manifolds, catalyst cases, etc. to nearly 900° C., their oxidation resistance was evaluated at 900° C. The oxidation resistance was determined by keeping a round rod test piece of 10 mm in diameter and 20 mm in length cut out of a portion of the ingot A about 30 mm from the bottom at 900° C. for 200 hours in the air, shot-blasting it to remove oxide scales, and then measuring weight change per a unit area before and after the oxidation test, namely weight loss (mg/cm$^2$) by oxidation. The measurement results of weight loss by oxidation are shown in Table 2.

The heat-resistant, ferritic cast steel used for exhaust members whose temperatures reach about 900° C. preferably has weight loss by oxidation (measured after being kept at 900° C. for 200 hours in the air) of 20 mg/cm$^2$ or less. When the weight loss by oxidation exceeds 20 mg/cm$^2$, an oxide film acting as starting points of cracking is formed excessively, resulting in insufficient oxidation resistance. As is clear from Table 2, all of the heat-resistant, ferritic cast steels of Examples 1-20 containing 16% or more of Cr important to secure oxidation resistance suffered weight loss by oxidation of 20 mg/cm$^2$ or less, meaning sufficient oxidation resistance for use in exhaust members heated to about 900° C. On the other hand, Comparative Example 5 containing Cr in as small an amount as 15.6% suffered as much weight loss by oxidation as 105 mg/cm$^2$, meaning insufficient oxidation resistance for use in exhaust members heated to about 900° C. These results verify that in order that the heat-resistant, ferritic cast steel has necessary oxidation resistance, the amount of Cr contained should be 16% or more.

(4) High-Temperature Strength and Thermal Deformation Resistance

In general, metals have lower strength at higher temperatures, vulnerable to thermal deformation. The heat-resistant, ferritic cast steel having a body-centered cubic (BCC) structure is lower than the heat-resistant, austenitic cast steel having a face-centered cubic (FCC) structure in high-temperature strength and thermal deformation resistance. Main factors having influence on the high-temperature strength and the thermal deformation resistance are their shapes and sizes as well as their high-temperature yield strength. To be used for exhaust members heated to about 900° C., the 0.2% yield strength at 900° C. is preferably 20 MPa or more.

To evaluate the high-temperature strength and thermal deformation resistance of exhaust members, a smooth, flanged, round rod test piece (diameter: 10 mm, and gauge distance: 50 mm) cut out of a portion of the ingot A about 30 mm from the bottom was attached to an electric-hydraulic servo test machine to measure 0.2% yield strength at 900° C. in the air. The measurement results of the 0.2% yield strength are shown in Table 2.

As is clear from Table 2, the 0.2% yield strength at 900° C. (high-temperature yield strength) was as high as 20 MPa or more in Examples 1-20. In Comparative Examples 1, 2, 8 and 10 containing small amounts of C and/or Nb, and Comparative Examples 13 and 14 having low Nb/C ratios, the high-temperature yield strength was less than 20 MPa. The area ratio of the eutectic (δ+NbC) phase was 60% or more in Examples 1-20, and less than 60% in Comparative Examples 1, 2, 8, 10, 13 and 14. These results verify that a relatively large amount of the eutectic (δ+NbC) phase crystallized improves not only the toughness, but also the high-temperature strength and the thermal deformation resistance. Because of a small C content, Comparative Example 19 had high high-temperature yield strength despite an insufficient amount of the eutectic (δ+NbC) phase. The reason therefor seems to be that Comparative Example 19 contains a large amount of Si. Also, Comparative Example 20 having a small Nb content has high high-temperature yield strength despite an insufficient amount of the eutectic (δ+NbC) phase. The reason therefor seems to be that Comparative Example 20 contains a large amount of W. The heat-resistant, ferritic cast steel of the present invention in which a large amount of the eutectic (δ+NbC) phase is crystallized has high-temperature strength on the same level as those of the heat-resistant cast steels of Comparative Examples 19 and 20, which have improved high-temperature strength by containing a large amount of Si or W.

(5) Thermal Fatigue Life

Exhaust members are required to be resistant to thermal cracking by the repetition of start (heating) and stop (cooling)

of engines, having long thermal fatigue lives. More cycles until cracking and deformation generated by the repeated heating and cooling cause thermal fatigue failure indicate a longer thermal fatigue life, meaning excellent heat resistance and durability.

The thermal fatigue life was measured by attaching a smooth, round rod test piece of 10 mm in diameter and 20 mm in gauge length cut out of a portion of the ingot A about 30 mm from the bottom to an electric-hydraulic servo test machine at a constraint ratio of 0.5, and repeating heating/cooling cycles in the air, each cycle consisting of temperature elevation for 2 minutes, keeping the temperature for 1 minute, and cooling for 4 minutes, 7 minutes in total, with the lowest cooling temperature of 150° C., the highest heating temperature of 900° C., and a temperature amplitude of 750° C., elongation and shrinkage by heating and cooling being mechanically constrained to cause thermal fatigue failure. A load-temperature diagram was determined from the change of a load caused by the repeated heating and cooling, and the maximum tensile load in the load-temperature diagram at the second cycle was used as a reference (100%), to count the number of heating/cooling cycles when the maximum tensile load decreased to 75%, as a thermal fatigue life. The measurement results of the thermal fatigue life are shown in Table 2.

The degree of mechanical constraint is expressed by a constraint ratio defined by (elongation by free thermal expansion−elongation under mechanical constraint)/(elongation by free thermal expansion). For instance, the constraint ratio of 1.0 is a mechanical constraint condition in which no elongation is permitted to a test piece heated, for instance, from 150° C. to 900° C. The constraint ratio of 0.5 is a mechanical constraint condition in which, for instance, only 1-mm elongation is permitted when the elongation by free thermal expansion is 2 mm. Accordingly, at a constraint ratio of 0.5, a compression load is applied during temperature elevation, while a tensile load is applied during temperature decrease. The constraint ratio was set at 0.5, because the constraint ratios of exhaust members for actual automobile engines are about 0.1-0.5 permitting elongation to some extent.

The heat-resistant, ferritic cast steel preferably has a thermal fatigue life of 1000 cycles or more under the conditions of a heating temperature upper limit of 900° C., a temperature amplitude of 750° C. or more and a constraint ratio of 0.5, such that it can be used for exhaust members whose temperatures reach about 900° C. With a thermal fatigue life of 1000 cycles or more, the heat-resistant, ferritic cast steel is regarded as having excellent thermal cracking resistance. As is clear from Table 2, the thermal fatigue life in any of Examples 1-20 was sufficiently as long as 1400 cycles or more. This indicates that the heat-resistant, ferritic cast steel of the present invention has sufficient thermal cracking resistance necessary for exhaust members whose temperatures reach about 900° C.

As described above, the heat-resistant, ferritic cast steel of the present invention has heat resistance characteristics (oxidation resistance, high-temperature strength, thermal deformation resistance and thermal cracking resistance), which are necessary for exhaust members whose temperatures reach about 900° C., as well as excellent room-temperature toughness.

TABLE 2

| | Evaluation Results | | | | |
|---|---|---|---|---|---|
| No. | Area Ratio (%) of Eutectic (δ + NbC) Phase | Impact Strength at Room Temperature ($\times 10^4$ J/m$^2$) | Weight Loss by Oxidation(1) (mg/cm$^2$) | 0.2% Yield Strength(2) (MPa) | Thermal Fatigue Life (cycles) |
| Example 1 | 62 | 21.9 | 3 | 20 | 1408 |
| Example 2 | 68 | 24.8 | 2 | 21 | 1412 |
| Example 3 | 87 | 22.1 | 2 | 24 | 1425 |
| Example 4 | 62 | 19.6 | 1 | 21 | 1413 |
| Example 5 | 70 | 24.0 | 1 | 22 | 1472 |
| Example 6 | 75 | 26.5 | 1 | 23 | 1531 |
| Example 7 | 87 | 22.0 | 1 | 24 | 1429 |
| Example 8 | 62 | 20.0 | 1 | 21 | 1524 |
| Example 9 | 70 | 25.1 | 1 | 23 | 1511 |
| Example 10 | 85 | 22.7 | 1 | 23 | 1502 |
| Example 11 | 70 | 23.0 | 1 | 23 | 1491 |
| Example 12 | 72 | 18.0 | 1 | 23 | 1537 |
| Example 13 | 69 | 18.1 | 1 | 24 | 1514 |
| Example 14 | 71 | 25.3 | 1 | 21 | 1518 |
| Example 15 | 68 | 24.8 | 1 | 20 | 1512 |
| Example 16 | 72 | 26.0 | 1 | 24 | 1508 |
| Example 17 | 73 | 22.4 | 10 | 23 | 1436 |
| Example 18 | 62 | 15.2 | 1 | 21 | 1545 |
| Example 19 | 60 | 17.5 | 1 | 20 | 1530 |
| Example 20 | 89 | 19.6 | 1 | 24 | 1542 |
| Comp. Ex. 1 | 51 | 9.0 | 1 | 18 | 1488 |
| Comp. Ex. 2 | 57 | 11.1 | 1 | 19 | 1457 |
| Comp. Ex. 3 | 95 | 12.1 | 1 | 23 | 1505 |
| Comp. Ex. 4 | 99 | 10.9 | 1 | 24 | 1432 |
| Comp. Ex. 5 | 75 | 25.3 | 105 | 22 | 1358 |
| Comp. Ex. 6 | 70 | 13.4 | 1 | 20 | 1521 |
| Comp. Ex. 7 | 60 | 6.3 | 1 | 21 | 1546 |
| Comp. Ex. 8 | 58 | 12.6 | 1 | 19 | 1507 |
| Comp. Ex. 9 | 86 | 11.8 | 1 | 22 | 1492 |
| Comp. Ex. 10 | 47 | 10.5 | 1 | 16 | 1424 |
| Comp. Ex. 11 | 98 | 9.7 | 1 | 24 | 1431 |
| Comp. Ex. 12 | 58 | 11.2 | 1 | 23 | 1443 |
| Comp. Ex. 13 | 57 | 12.1 | 1 | 19 | 1406 |
| Comp. Ex. 14 | 55 | 8.8 | 1 | 17 | 1429 |

TABLE 2-continued

| No. | Evaluation Results | | | | |
|---|---|---|---|---|---|
| | Area Ratio (%) of Eutectic (δ + NbC) Phase | Impact Strength at Room Temperature ($\times 10^4$ J/m$^2$) | Weight Loss by Oxidation[(1)] (mg/cm$^2$) | 0.2% Yield Strength[(2)] (MPa) | Thermal Fatigue Life (cycles) |
| Comp. Ex. 15 | 75 | 11.2 | 1 | 20 | 1484 |
| Comp. Ex. 16 | 76 | 9.1 | 1 | 21 | 1437 |
| Comp. Ex. 17 | 70 | 11.8 | 1 | 28 | 1551 |
| Comp. Ex. 18 | 69 | 10.0 | 1 | 29 | 1564 |
| Comp. Ex. 19 | 45 | 5.5 | 1 | 35 | 1512 |
| Comp. Ex. 20 | 36 | 7.0 | 1 | 24 | 1413 |
| Comp. Ex. 21 | 76 | 11.9 | 1 | 33 | 1558 |

Note:
(1)Measured at 900° C. in the air.
(2)Measured at 900° C. in the air.

Example 21

The heat-resistant, ferritic cast steel of Example 6 was cast to form an exhaust manifold (main thickness: 4.0-6.0 mm) for automobiles, subject to a mold shakeout step, a step of cutting off casting design portions (ingates), a cleaning step by shot blasting, and a finishing step of removing flash, etc., and then machined, in an as-cast state. The resultant exhaust manifold suffered neither cracking, fracture, and casting defects such as shrinkage cavities, misrun, gas defects, etc., nor machining trouble, the abnormal wear and damage of cutting tools, etc.

This exhaust manifold was assembled to an exhaust simulator corresponding to a high-performance, inline, four-cylinder, gasoline engine with displacement of 2000 cc. To measure a life until penetrating cracks were generated, and how cracking and oxidation occurred, a durability test was conducted by repeating a cycle consisting of heating for 10 minutes and cooling for 10 minutes, under the conditions that the exhaust gas temperature under full load was about 1000° C. at an outlet of a converging portion of the exhaust manifold, a downstream side of the exhaust gas, and that the converging portion of the exhaust manifold had the highest surface temperature of about 910° C. and the lowest cooling temperature of about 90° C., with a temperature amplitude of about 820° C. The targeted number of heating/cooling cycles was 1200 cycles.

The durability test revealed that this exhaust manifold passed 1200 cycles of the durability test without suffering the leakage of an exhaust gas and cracking. Appearance inspection and penetrant inspection after the durability test revealed that the exhaust manifold suffered neither cracking nor fracture, much less penetrating cracking, in any portions including the thinnest branch pipes, with little oxidation on the entire surface. This confirmed that the exhaust manifold of the present invention had excellent heat resistance, durability and toughness.

As described above, exhaust members made of the heat-resistant, ferritic cast steel of the present invention had high oxidation resistance and thermal cracking resistance at about 900° C., as well as excellent room-temperature toughness. The exhaust members of the present invention made of the heat-resistant, ferritic cast steel containing small amounts of rare metals are inexpensive, and expand ranges to which fuel-efficiency-improving technologies are applicable, thereby contributing to reducing the amount of a $CO_2$ gas exhausted.

Though exhaust members for automobile engines have been explained above, the applications of the heat-resistant, ferritic cast steel of the present invention are not restricted thereto, but may be used for various cast parts required to have excellent heat resistance and durability such as high oxidation resistance and thermal cracking resistance, as well as high room-temperature toughness, for instance, combustion engines for construction machines, ships, aircrafts, etc., thermal equipments for melting furnaces, heat treatment furnaces, combustion furnaces, kilns, boilers, cogeneration facilities, etc., petrochemical plants, gas plants, thermal power generation plants, nuclear power plants, etc.

Effect of the Invention

The heat-resistant, ferritic cast steel of the present invention has excellent room-temperature toughness, as well as high oxidation resistance and thermal cracking resistance at about 900° C., without a heat treatment, enjoying high performance and inexpensiveness. In addition, suppressed rare metal contents reduce material costs, contributing to the effective use and stable supply of resources. Exhaust members made of the heat-resistant, ferritic cast steel of the present invention having such features can be produced at a low cost, expanding ranges to which fuel-efficiency-improving technologies are applicable, thereby contributing to reducing the amount of a $CO_2$ gas exhausted from automobiles, etc.

What is claimed is:

1. A heat-resistant, ferritic cast steel having excellent room-temperature toughness, which has a composition comprising by mass 0.32-0.48% of C,
0.85% or less of Si,
2% or less of Mn,
1.5% or less of Ni,
16-19.8% of Cr,
3.2-5% of Nb,
Nb/C being 9-11.5,
0.15% or less of N,
0.002-0.2% of S, and
0.8% or less in total of W and/or Mo,
the balance being Fe and inevitable impurities, and a structure in which a eutectic (δ+NbC) phase formed from a δ phase and Nb carbide (NbC) has an area ratio of 60-90%.

2. An exhaust member made of the heat-resistant, ferritic cast steel having excellent room-temperature toughness recited in claim 1.

* * * * *